US005292359A

United States Patent [19]

Jeng-Shyong et al.

[11] Patent Number: 5,292,359

[45] Date of Patent: Mar. 8, 1994

[54] PROCESS FOR PREPARING SILVER-PALLADIUM POWDERS

[75] Inventors: Jean Jeng-Shyong; Cheau Tei-Chih, Hsinchu, both of Taiwan

[73] Assignee: Industrial Technology Research Institute, Hsinchu, Taiwan

[21] Appl. No.: 93,521

[22] Filed: Jul. 16, 1993

[51] Int. Cl.[5] ..... B22F 9/24

[52] U.S. Cl. ..... 75/351; 75/370; 75/371; 148/430; 148/431; 420/505

[58] Field of Search ..... 75/351, 370, 371, 741; 423/22, 23, 24; 148/430, 431; 420/505

[56] References Cited

U.S. PATENT DOCUMENTS 4,776,883 10/1988 Hayashi et al. ..... 75/365

FOREIGN PATENT DOCUMENTS 2329352 1/1975 Fed. Rep. of Germany ..... 75/371

54-121270 9/1979 Japan ..... 75/371

*Primary Examiner*—R. Dean

*Assistant Examiner*—Sikyin Ip

*Attorney, Agent, or Firm*—W. Wayne Liauh

[57] ABSTRACT

The present invention relates to a process for preparing silver-palladium powders that may be used for the production of electrode materials, contacts or the like used in the electronic industries. The process comprises the steps of forming an acid solution containing silver and palladium ions; adding the acid solution while stirring to an aqueous solution containing a hydrazine and a surfactant system; and forming reduction-separated silver-palladium fine powders having an average particle diameter less than 1.0 micron and a specific surface area lower than 6.0 $m^2/g$.

4 Claims, 6 Drawing Sheets

PROCESS FOR PREPARING SILVER-PALLADIUM POWDERS

FIELD OF THE INVENTION

The present invention relates to a process for preparing silver-palladium powders that may be used for the production of electrode materials, contacts or the like used in the electronic industries, in particular to a process for preparing silver-palladium powders having a significantly low specific surface area.

BACKGROUND OF THE INVENTION

In the electronic industries, silver-palladium pastes have been widely used in thick film conductive circuits employed in screen printing. The objects of using silver-palladium alloys are to repress the migration from occurring when wiring is made by the use of silver alone, to raise the melting point of silver by adding palladium so that the conditions for using substrates at desired temperatures are applicable, and the like.

U.S. Pat. No. 4,776,883 discloses a process for the production of silver-palladium alloy fine powder comprising the steps of forming an acid solution containing silver and palladium as ions; adding hydrazine or a hydrazine compound to said acidic solution; forming reduction-separated silver-palladium alloy fine powders having an average particle diameter of 0.01-1.0 microns; and heat-treating said reduction-separated silver-palladium alloy fine powders at a temperature of 100°-500° C. in an inert atmosphere or in a vacuum, wherein said silver-palladium alloy fine powders have a specific surface area ranging from 13-20 $m^2/g$ prior to said heat-treatment, which is reduced to about 5-10 $m^2/g$ after said heat-treatment. As it is well known to those skilled in the art, the reduced specific area of the silver-palladium fine powders can prevent the occurrence of increased oil absorption, lowered oxidation resistance and other inconveniences, which are results of using silver-palladium powders having a large specific surface area when the silver-palladium powders are used in a circuit screen printing paint or paste.

The objects of the present invention are to provide a process for preparing uniform silver-palladium powders having a specific surface area lower than that of the prior art silver-palladium fine powders; eliminating the energy intensive heat-treating step of the prior art process and thus reducing the captial investment on the heat-treating equipment and the plant space for accommodating said heat-treating equipment.

SUMMARY OF THE INVENTION

In order to achieve the objects of present invention, a process for preparing silver-palladium powders comprising the steps of forming an acid solution containing silver and palladium as ions; adding said acid solution while stirring to an aqueous solution containing a hydrazine and a surfactant system; and forming reduction-separated silver-palladium fine powders having an average particle diameter less than 1.0 micron is disclosed.

The suitable amount of the hydrazine contained in said aqueous solution is 1-10, preferably 2-10, times the equivalent required for reduction of the sum of the silver ions and the palladium ions contained in said silver-palladium acidic solution. The surfactant system contains 0.5-5.0% caprylic acid and 0.5-5.0% triethanolamine, or 0.25-1.30% oleic acid and 0.25-1.30% triethanolamine, based on the volume of said aqueous solution.

BRIEF DESCRIPTION OF THE DRAWINGS

FIG. 1 is a plot which shows the particle diameter distribution of silver-palladium fine powders prepared by one of the preferred embodiments of present invention as illustrated in the following Example 1.

FIG. 2 is a plot which shows the particle diameter distribution of silver-palladium fine powders prepared by another preferred embodiments of present invention as illustrated in the following Example 2.

DETAILED DESCRIPTION OF THE INVENTION

Figure 10:
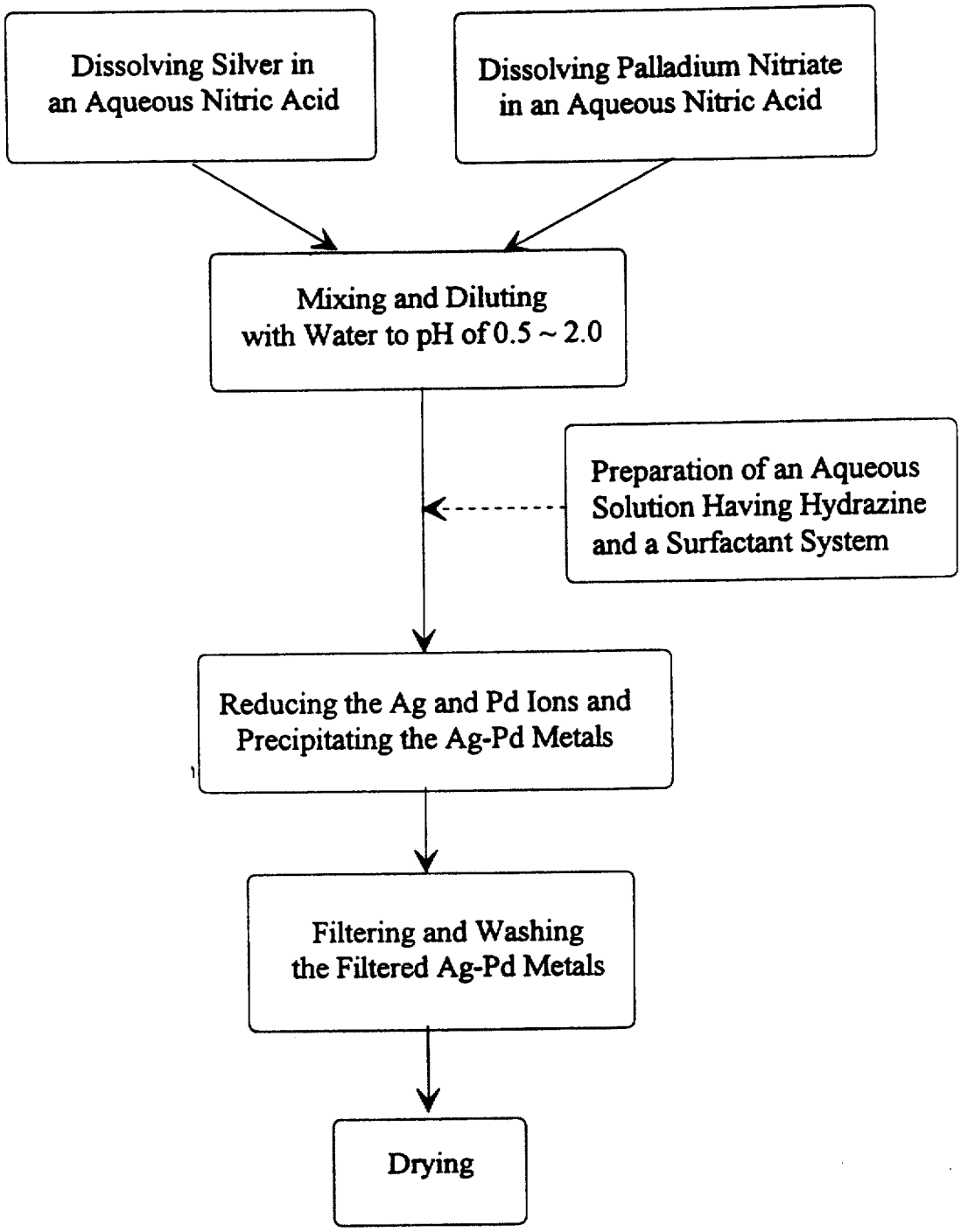
FIG. 10 is a schematic diagram illustrating a preferred embodiment of the steps of the process disclosed in the present invention for preparing silver-palladium powders.

One of the preferable embodiments of the present process for preparation of silver-palladium powders is described by referring to FIG. 10, which comprises the steps of:

1) dissolving palladium nitrate and silver in aqueous nitric acid solutions separately, mixing the resulting aqueous nitric acid solutions and diluting the mixed nitric acid solution with pure water until a pH value of 0.5-2.0 is obtained;

2) preparing an aqueous solution of a hydrazine and a surfactant system consisting of 0.5-5.0% of caprylic acid and 0.5-5.0% of triethanolmine, based on the volume of the aqueous solution, or 0.25-1.30% of oleic acid and 0.25-1.30% of triethanolamine, based on the volume of the aqueous solution;

3) adding the diluted mixed nitric acid solution from step 1) to the aqueous solution from step 2) while stirring at 200-500 rpm such that the silver and palladium ions contained in said diluted mixed nitric acid solution are reduced to their corresponding metals, respectively and precipitated therefrom, wherein the amount of hydrazine contained in the aqueous solution is 1-10 times the stoichiometric amount needed to reduce the silver and palladium ions, and the reduction reaction is carried out at 35°-50° C.; and 4) recovering said precipitated silver and palladium metals from said reaction mixture by filtration, washing the recovered silver and palladium metals with an organic solvent and water, and drying the washed metals to obtain silver-palladium fine powders.

The main characteristic of present process is using a surfactant system containing caprylic acid or oleic acid and triethanolamine in an aqueous solution containing a hydrazine for reducing and precipitating silver and palladium ions from the nitric acid solution. The advantages of present process are: eliminating the heat treatment step of the prior art process and thus simplifying the operations thereof; substantially no silver and palladium ions remaining in the reaction mixture after the reduction reaction being completed, and thus achieving high productivity of pure silver-palladium powders. Moreover, the surfactant system can inhibit the particle diameter growth of reduction-precipitated silver-palladium powders and help the formation of uniform silver-palladium mixed or alloy powders in effectiveness. It is also found that the reduction reaction temperature can be adjusted to control the specific surface area, the tap density, and the type (mixed or alloy) of silver-palladium powders prepared by the present process. It is also believed that the specific surface area, the tap density and the type of silver-palladium powders formed by the present process can be adjusted by adjusting the concentration of silver and palladium ions in said nitric solutions, pH value of the diluted mixed nitric acid solution, the surfactant amount, the hydrazine amount, and the stirring speed of the reaction.

The invention will be further illustrated by the following examples.

EXAMPLES 1 and 2

The processes illustrated by the present Examples 1 and 2 are similar except that the reduction reaction temperature of Example 1 is 40° C. and is 50° C. for Example 2.

Figure 4:
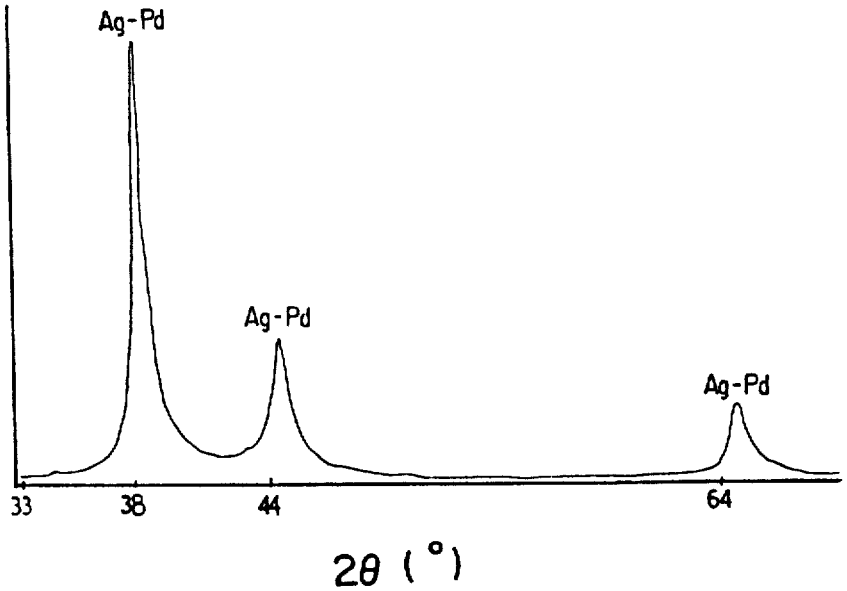
FIG. 4 is an X-ray diffraction view of the silver-palladium fine powders of FIG. 1.
Figure 5:
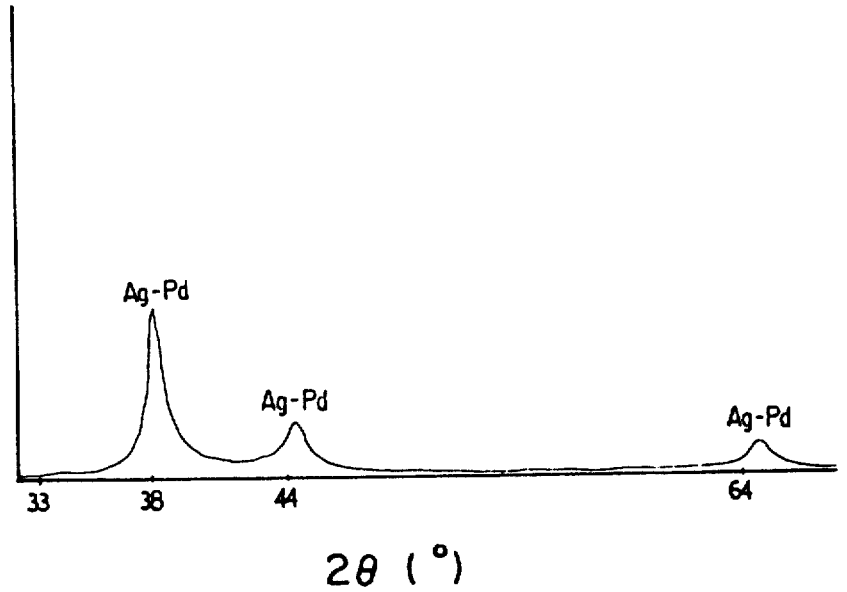
FIG. 5 is an X-ray diffraction view of the silver-palladium fine powders of FIG. 2.

In accordance with the steps disclosed in FIG. 10, 110 g of 99.95% purity solid silver was dissolved in 5.33 N nitric acid aqueous solution under heating to obtain 350 ml homogeneous solution, and 50 g of 40% palladium nitrate was dissolved in 16 N nitric acid aqueous solution under heating to obtain 150 ml homogeneous solution. The two resulting homogeneous solutions were mixed and diluted with pure water until a total volume of 3000 ml was reached. The diluted mixed nitric acid solution, having a pH value of 0.80, and silver and palladium ion concentrations of 36.67 g/l and 6.67 g/l respectively, was added dropwisely at a rate of 65 ml/min. to an aqueous solution containing a reductant and a surfactant system for reducing the silver and palladium ions to their corresponding metals and precipitating the metals, respectively therefrom. The aqueous solution containing a reductant and a surfactant system had been prepared in advance by mixing 100 ml hydrazine, 100 ml caprylic acid and 100 ml triethanolamine, and diluting with pure water to a total volume of 3000 ml, which has a reduction potential of −400 mV with respect to a $Hg_2Cl_2$-Hg electrode at 40° C. right after its preparation. The reaction mixture was stirred t 300–350 rpm and maintain at a constant temperature of 40° C. or 50° C. During the course of reduction reaction, the reduction potential of the reaction mixture was measured and found that it decreased from the initial −400 mV to −700 mV and then rised to −50–+100 mV in the end of the reduction reaction, with respect to a $Hg_2Cl_2$-Hg electrode. The precipitated powders were collected by filtration, washed with a 5% acetone aqueous solution to remove $OH^{31}$ therefrom, and then dried in an oven at 95° C. for two hours. The products prepared at the two different reduction reaction temperatures, 40° and 50° C., weigh 129–130 g, and have a similar composition of about Ag:Pd=85:15. From their X-ray diffraction results, FIGS. 4 and 5, the products obtained are silver-palladium alloy fine powders.

Atomic analysis of the products: Ag:Bal, Pd:14.93%~15.44%, Na:0.0040%~0.0042%, K:−, Ca:0.0025%~0.0035%, Mg:<0.0030%, Cu:<0.001%, Pb:0.0053~0.0080%, Ni:0.0037~0.0045%, Fe:<0.0033%, Cl:<0.001%.

The reaction temperature and the properties of the products are listed in Table 1.

TABLE 1

| | Example 1 | Example 2 |
|---|---|---|
| Reaction temp, °C. | 40 | 50 |
| Tap density[1], g/cm³ | 1.62 | 1.27 |
| Specific surface area[2], m²/g | 5.75 | 0.48 |
| Average particle diameter[3], μm | | |
| Particle meter method | 0.88 (FIG. 1) | 0.75 (FIG. 2) |
| SEM method | <0.40 (FIG. 7) | <0.30 (FIG. 8) |
| Palladium content, % | 15.44 | 14.93 |

Figure 7:
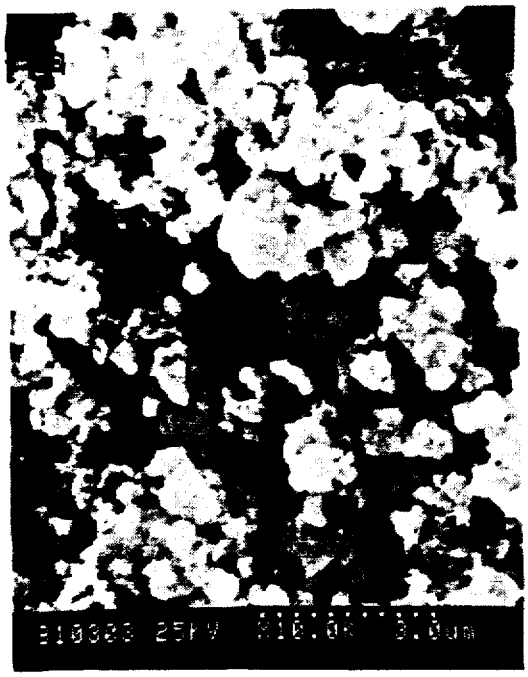
FIG. 7 is a magnified photograph of the silver-palladium fine powders of FIG. 1 taken by SEM.
Figure 8:
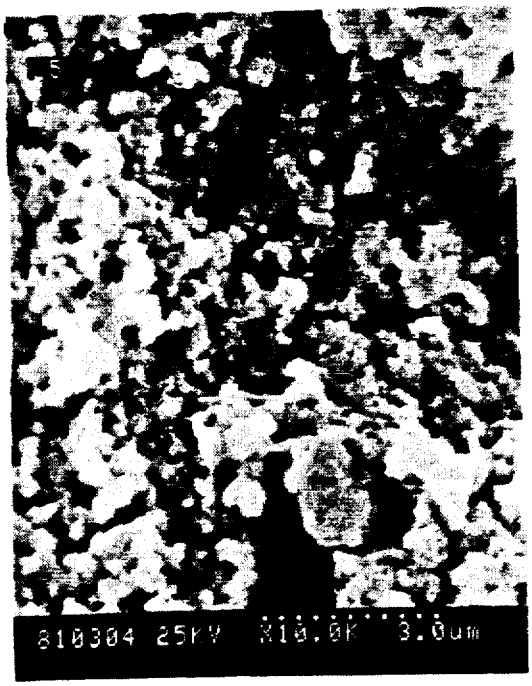
FIG. 8 is a magnified photograph of the silver-palladium fine powders of FIG. 2 taken by SEM.

[1]ASTM B527-81, "Stand Test Method for Tap Density of Powders of Refractory Metals and Compounds by Tap-pak Volumeter".
[2]It is determined by using a specific surface area measuring meter to measure the surface area of liquid nitrogen desorbed from per gram of powders.
[3]Particle meter method: the distribution of particle diameters is measured by using a particle meter manufactured Galal Co.. Isreal, as shown in FIGS. 1 and 2. The average particle diameter is then calculated from the distribution.
SEM method: the average particle diameter is calculated from the diameters which are determined by directly measuring the particles sizes in magnified photographs taken by SEM, as shown in FIGS. 7 and 8.

It can be seen from the data in Table 1 that the reduction reaction temperature has a significant effect on the specific surface area of silver-palladium powders prepared by the present process.

EXAMPLE 3

To a mixture of 100 ml hydrazine, 15 ml oleic acid, 35 ml triethanolamine and 2850 ml pure water, the diluted mixed nitric acid solution containing 36.67 g/l silver ions and 6.67 g/l palladium ions as that prepared in the Example 1 was added at a rate of 65 ml/min. The reaction mixture was stirred at 300–400 rpm and maintained at 35° C. The precipitate formed in the reaction mixture was recovered in the same way as the Example 1. Yield, >99.5%.

Figure 6:
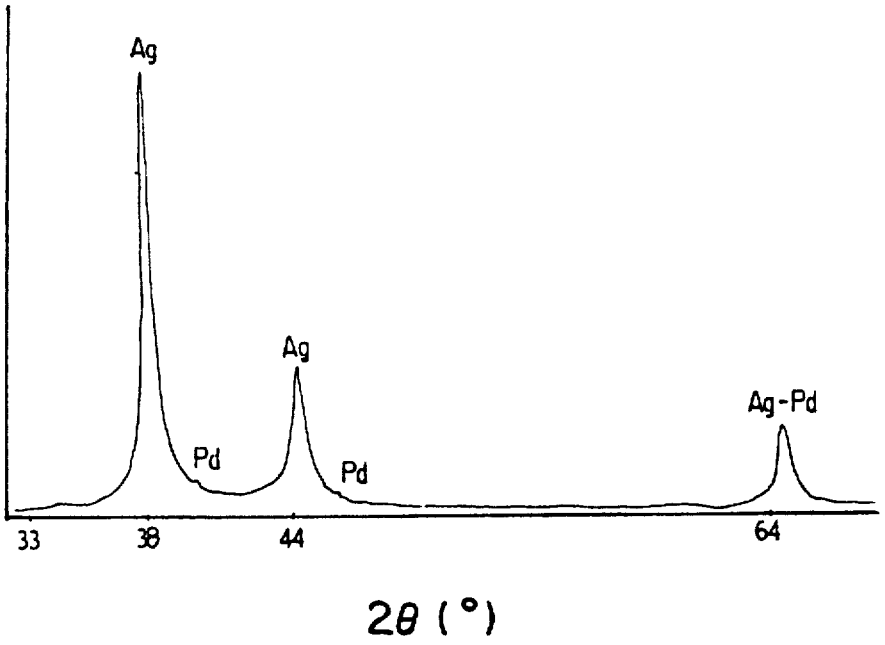
FIG. 6 is an X-ray diffraction view of the silver-palladium fine powders of FIG. 3.
Figure 7:
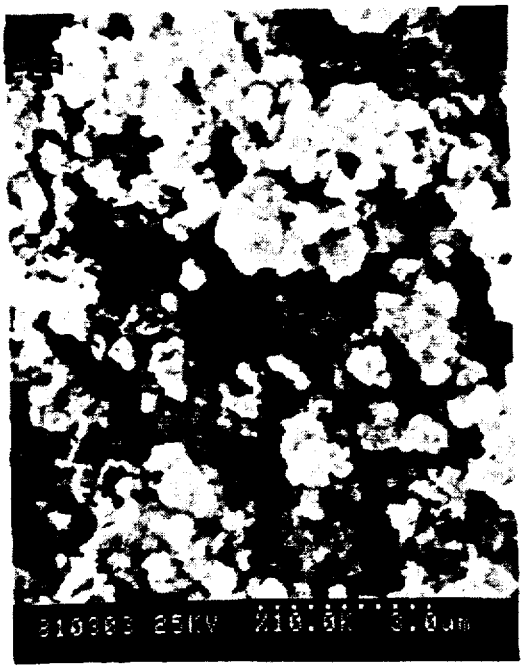
Figure 8:
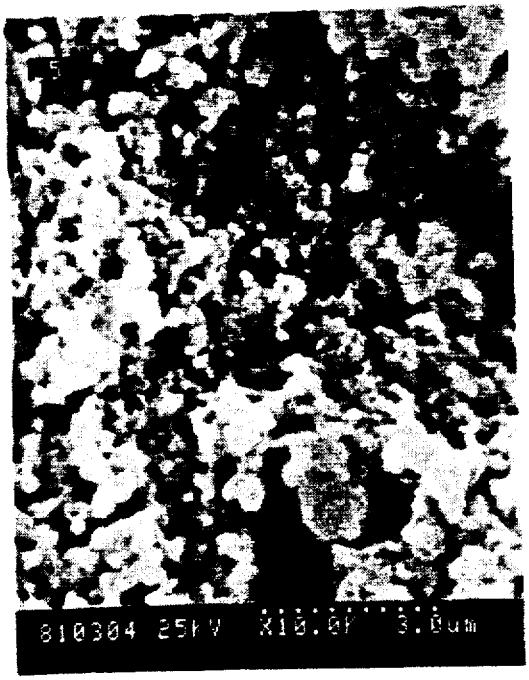
Figure 9:
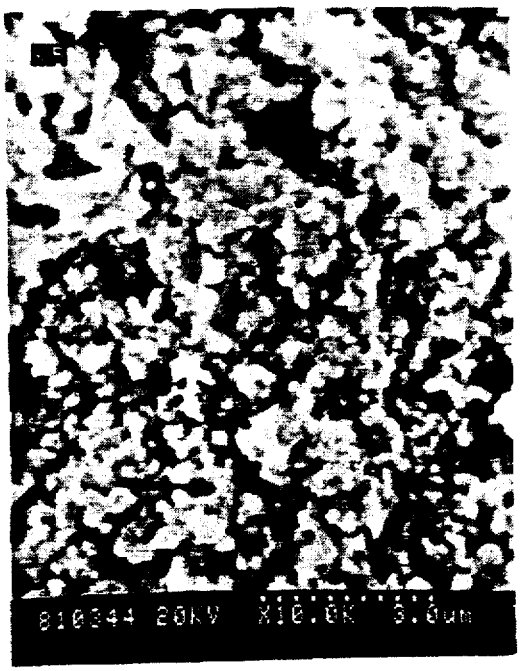

The X-ray diffraction result is shown in FIG. 6, from which it can be seen that the powders prepared by the present example are silver-palladium mixed powders.

Atomic analysis of the product: Ag:Bal, Pd:15.11%, Na:0.0042%, K:−, Ca:0.0044%, Mg:<0.0030%, Cu:0.0029%, Pb:0.0060%, Ni:0.0033%, Fe:<0.0034%, Cl:<0.001%.

Figure 9:
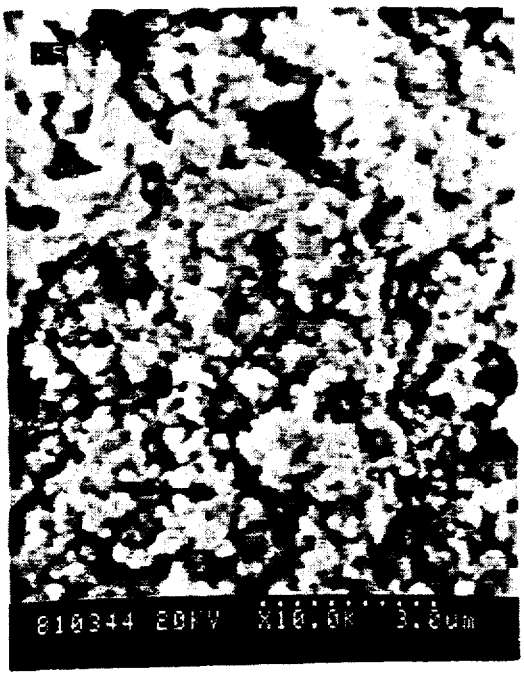
FIG. 9 is a magnified photograph of the silver-palladium fine powders of FIG. 3 taken by SEM.
Figure 3:
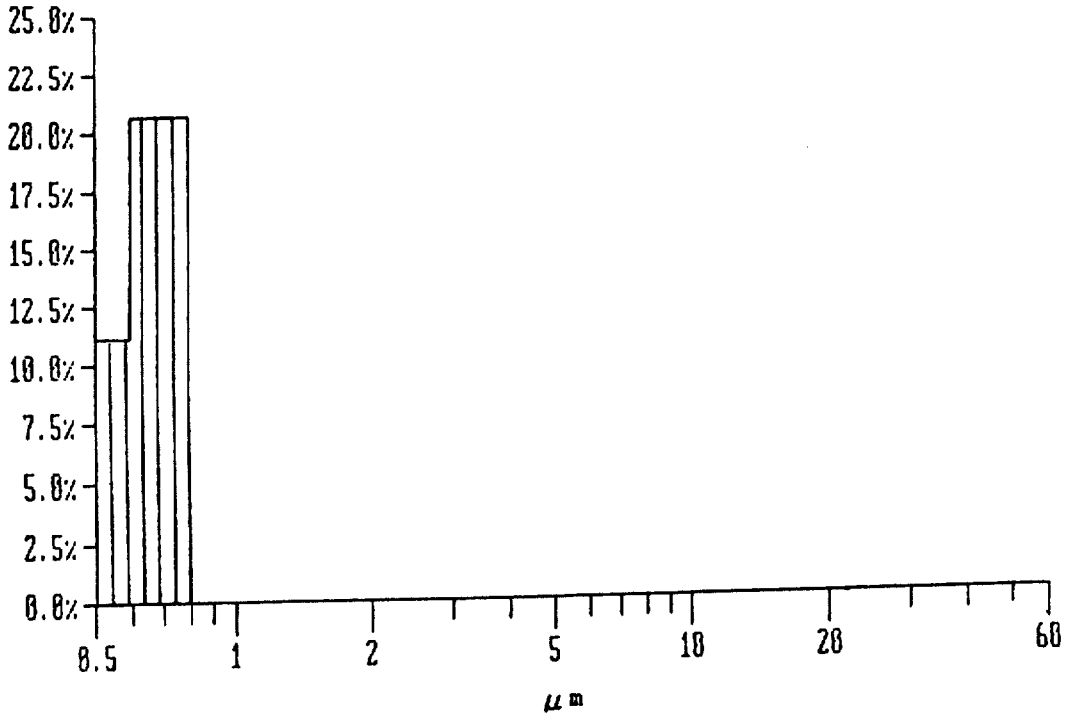
FIG. 3 is a plot which shows the particle diameter distribution of silver-palladium fine powders prepared by the other preferred embodiments of present invention as illustrated in the following Example 3.

The properties of the silver-palladium mixed powders are as follows:

Average particle diameter: <0.3 μm, from the SEM photograph shown in FIG. 9; 0.65 μm, from the particle diameter distribution shown in FIG. 3.

Tap density: 1.56 g/cm³.

Specific surface area: 0.88 m²/g.

As illustrated in the above Examples 1–3, the silver-palladium powders prepared by the present invention are very fine and uniform in particle size. In particular, the silver-palladium powders produced by the present invention have a specific surface area lower than 1.0 m²/g, which is significantly lower than that of commercially available products and not able to be accomplished by the prior art processes. In Table 2 that follows, the properties of silver-palladium powders prepared by the present invention are compared with those of commercially available products and U.S. Pat. No. 4,776,883.

TABLE 2

| Products[1)] | Average particle diameter by SEM, μm | Specific surface area, $m^2/g$ before heat treatment | Specific surface area, $m^2/g$ after heat treatment[2)] |
|---|---|---|---|
| Metz #3015 | 1-3.73 | — | 3.6 |
| Tanaka #D2854 | 0.4 | — | 1.48 |
| Mitsui-A | 0.2 | 13.1 | 4.5-8 |
| Mitsui-B | 0.2 | 20 | 4.5-9.5 |
| Example 1 | <0.4 | 5.75 | — |
| Example 2 | <0.3 | 0.48 | — |
| Example 3 | <0.3 | 0.88 | — |

[1)]Metz #3015 product is available from Metz Co., U.S.A.
Tanaka #D2854 product is available from Tanaka Co., Japan
Mitsui-A and B data are taken from Tables 1-2 of U.S. Pat. No. 4,776,883.
[2)]Heat treatment is carried out in nitrogen atmosphere at 200-500° C.

We claim:

1. A process for preparation of silver-palladium fine powders comprising the steps of:

(a) dissolving palladium nitrate and silver in aqueous nitric acid solutions separately, mixing the resulting aqueous nitric acid solutions and diluting the mixed nitric acid solution with pure water until a pH value of 0.5-2.0 is obtained;

(b) preparing an aqueous solution of a hydrazine and a surfactant system containing 0.5-5.0% of caprylic acid and 0.5-5.0% of triethanolamine, based on the volume of the aqueous solution, or 0.25-1.30% of oleic acid and 0.25-1.30% of triethanolamine, based on the volume of the aqueous solution;

(c) adding the diluted mixed nitric acid solution from step (a) to the aqueous solution from step (b) while stirring at 200-500 rpm to effectuate a reduction reaction such that the silver and palladium ions contained in the diluted mixed nitric acid solution are reduced to their corresponding metals, respectively, and precipitated therefrom, wherein the amount of hydrazine contained in the aqueous solution is 1-10 times the stoichiometric amount needed to reduce the silver and palladium ions, and the reduction reaction is carried out at 35°-50° C., and (d) recovering said precipitated silver and palladium metals from said reaction mixture by filtration, washing the recovered silver and palladium metals with an organic solvent and water, and drying the washed metals to obtain silver-palladium fine powders.

2. The process according to claim 1, wherein said surfactant system contains 0.5-5.0% of caprylic acid and 0.5-5.0% of triethanolamine, based on the volume of the aqueous solution.

3. The process according to claim 1, wherein said surfactant system contains 0.25-1.30% of oleic acid and 0.25-1.30% of triethanolamine, based on the volume of the aqueous solution.

4. The process according to claim 1, wherein the aqueous solution prepared in step (b) has a reduction potential of −400 mV with respect to a $Hg_2Cl_2$-Hg electrode.

* * * * *